US005293506A

United States Patent [19]

Yorita

[11] Patent Number: 5,293,506

[45] Date of Patent: Mar. 8, 1994

[54] VACUUM SWITCH TUBE INCLUDING WINDMILL ELECTRODES

[75] Inventor: Mitsumasa Yorita, Kagawa, Japan

[73] Assignee: Mitsubishi Denki Kabushiki Kaisha, Tokyo, Japan

[21] Appl. No.: 897,032

[22] Filed: Jun. 11, 1992

[30] Foreign Application Priority Data

Jun. 17, 1991 [JP] Japan ..... 3-171718

[51] Int. Cl.[5] ..... H01H 33/66

[52] U.S. Cl. ..... 200/144 B

[58] Field of Search ..... 200/144 A, 144 B, 279

[56] References Cited

U.S. PATENT DOCUMENTS

| | | | |
|---|---|---|---|
| 3,280,286 | 10/1966 | Ranheim | 200/144 B |
| 4,210,790 | 7/1980 | Kurosawa et al. | 200/144 B |
| 4,324,960 | 4/1982 | Aoki et al. | 200/144 B |
| 4,445,015 | 4/1984 | Zueckler | 200/144 B |
| 4,473,731 | 9/1984 | Yorita | 200/144 B |
| 4,806,714 | 2/1989 | Aoki | 200/144 B |
| 5,059,752 | 10/1991 | Inagaki | 200/144 B |

FOREIGN PATENT DOCUMENTS

| | | |
|---|---|---|
| 0082801 | 6/1983 | European Pat. Off. . |
| 55-91024 | 6/1980 | Japan . |
| 58-100325 | 6/1983 | Japan . |
| 58-173145 | 11/1983 | Japan . |
| 61-197627 | 12/1986 | Japan . |
| 62-31917 | 2/1987 | Japan . |
| 62-64939 | 4/1987 | Japan . |
| 2-86021 | 3/1990 | Japan . |
| 2111309 | 6/1983 | United Kingdom . |

OTHER PUBLICATIONS

*Patent Abstracts of Japan*, vol. 13, No. 232 (E-765) (3580), May 29, 1989, JP-A-1038937.

*Primary Examiner*—J. R. Scott

*Attorney, Agent, or Firm*—Burns, Doane, Swecker & Mathis

[57] ABSTRACT

A vacuum switch tube has a pair of windmill type electrodes and a pair of electrode bars located within the tube. Each windmill type electrode includes an auxiliary electrode that includes a central hub portion having an axis, and a plurality of arcuate arms. Each arcuate arm has proximate and distal ends, and is attached at the proximate end to the central hub portion and extends in a spiral direction along a plane that is substantially perpendicular to the axis of the hub portion. Each arcuate arm also has a connecting portion formed on a top side of the arcuate arm near the distal end. Each windmill type electrode further includes a ring-shaped electrode having top and bottom sides, the bottom side being connected to the connecting portions of the plurality of arcuate arms. Each one of the pair of electrode bars has a top end upon which is mounted the hub of one of the pair of windmill type electrodes so that the hub axis is coincident with an axis of the electrode bar. The electrode bars are disposed in axial alignment within the vacuum switch tube so that the pair of windmill type electrodes are engageable and disengageable with one another. Accordingly, rotation of the arc current is enhanced.

5 Claims, 3 Drawing Sheets

VACUUM SWITCH TUBE INCLUDING WINDMILL ELECTRODES

BACKGROUND OF THE INVENTION

1. Field of the Invention

The present invention relates to an improvement of a windmill type electrode for use in a vacuum switch tube.

2. Description of the Prior Art

A conventional vacuum circuit breaker is constructed such that an electrode provided therein is formed with grooves to control an electric current flowing in the electrode and form an alternate loop-like electric way in a substantially circumferential direction, whereby an arc current generated in the electrode is activated in accordance with the magnetic field produced by the loop-like electric way, so that a partial dissolution of the electrode can be avoided and thus the breaking function thereof as a whole can be greatly improved thereby.

FIGS. 8 and 9 are illustrations each showing a windmill type electrode disposed in a vacuum switch tube as conventionally disclosed by Japanese Patent Publication No. 56-36774. In the figures, reference number 1 denotes a pair of electrode bars disposed inside the vacuum tube (not shown); one of which is a fixed electrode bar and the other is a perpendicularly movable electrode bar which is located right beneath the fixed electrode bar opposing thereto, wherein a detachable windmill type electrode 2 is mounted at the end portion of each of these electrode bars in such a manner that two windmill type electrodes are facing respectively to each other.

The windmill type electrode 2 is provided with a plurality of arc current passing surfaces 20, 20A and 20B formed in the external periphery thereof which are to be brought into contact with the other electrode opposing thereto, and also provided with a plurality of grooves 21, 21A and 21B which are placed therein in such a form as to extend from the external side towards the inner side of the electrode, wherein the center portion thereof is formed in a dented shape. By the way, the grooves 21, 21A and 21B respectively comprise a portion that contacts with an inner circle of the corresponding arc passing surface 20, 20A and 20B, and a portion which is in parallel with the groove adjacent to the arcuate portion of the inner circle. In FIG. 8, the points A, E, G and H of the arc current passing surfaces 20, 20A and 20B respectively indicate the points in which the arc current 3 is generated in the respective arc current passing surfaces.

With the above construction, when the electrodes 2 in FIG. 9 are opened, an arc current 3 is generated on one of the arc current passing surface 20, 20A or 20B. The arc current generated at one of the points A, E or G of the respective arc current passing surfaces 20, 20A and 20B receives a magnetic activating force produced by the effect of the current flowing path of the electric current I made in accordance with the grooves 21, 21A and 21B, and moves along the circumferential direction F as shown in FIG. 8. Thereafter, the arc current 3 continues to receive the magnetic activating force even after it reaches to the groove 21, 21A or 21B, and thereby passes over the groove to the adjacent arc current passing surface to rotate around.

In addition to the reference mentioned above, other references that disclose this type of conventional vacuum circuit breaker are Japanese Patent Application Laid Open No. 2-142024, 62-31917, 58-100325, Japanese UM Reg. Application No. 55-91024, 58-173145, 61-197627, 62-64939 and Japanese Patent Application Laid Open No. 2-86021 as the prior arts of this type apart from the above mentioned prior art.

However, since the conventional vacuum switch tube is constructed as above and the electrode 2 is formed with a plurality of delved grooves 21, 21A and 21B, the time required for the arc current to pass over these grooves varies and sometimes the movement thereof stands still. Also, if the point at which the arc current is generated is H in the arc current passing surface 21A as shown in FIG. 8, a magnetic activating force to activate the arc current 3 by way of the path of the electric current I is applied to the direction in which the arc current is pushed towards outside the circle, and for this reason the arc current 3 can not smoothly rotate on the arc current passing surfaces 20, 20A and 20B.

SUMMARY OF THE INVENTION

The present invention has been made to eliminate such problems as described above, and it is an object of the present invention to provide a vacuum switch tube which is capable of raising the activating force of the arc current in the circumferential direction and thereby improving the function thereof as a breaker.

In order to attain the above object, the present invention provides a vacuum switch tube comprising therein a pair of electrode bars and a pair of windmill type electrodes which are disposed at the respectively facing end portions of the electrode bars, the windmill type electrodes being mounted detachably from each other therein, wherein each of the pair of windmill type electrodes further comprises: an auxiliary electrode whose center portion is fixed to the electrode bar and having a plurality of arcuate arms extendingly directed from the center portion toward the external periphery thereof; and an annular electrode which is integrally connected to a plurality of connecting portions provided at a far end of each of the arcuate arms thereby to give a rotation to an arc current. With this construction, even when an arc current is generated, it is capable of continuing a stable rotation without an occurrence of any variation of its moving velocity, so that the breaking function thereof can be greatly improved.

In accordance with the present invention, since the current path along which an electric current flows in the arm portion of the auxiliary electrode coincides with the activating direction of the arc current, the arc current generated on the annular electrode always receives the magnetic activating force in the circumferential direction and thereby smoothly rotates. Further, since there are no grooves delved in the annular electrode, the rotation of the arc current is substantially smooth.

BRIEF DESCRIPTION OF THE DRAWINGS

The above and other objects, features and advantages of the present invention will become apparent from the following description taken in conjunction with the accompanying drawings, in which.

DETAILED DESCRIPTION OF THE INVENTION

Figure 1:
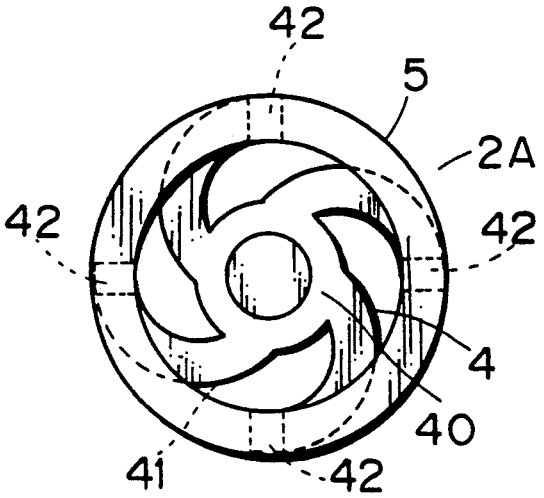
FIG. 1 is a plan view showing one embodiment of a vacuum switch tube according to the present invention.
Figure 2:
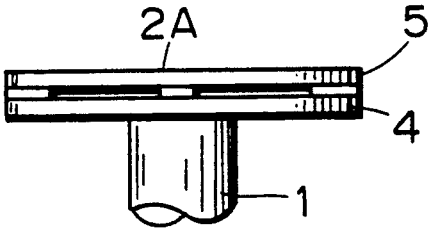
FIG. 2 is a side view of FIG. 1.
Figure 3:
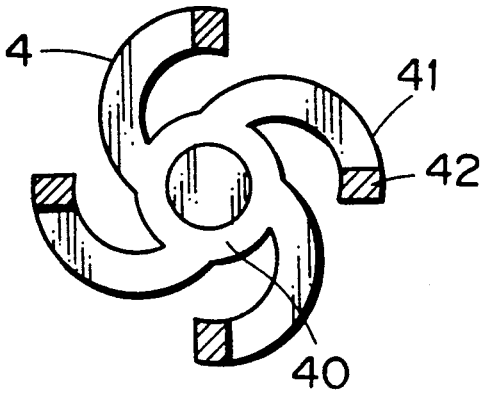
FIG. 3 is a plan view showing one embodiment of an auxiliary electrode of the vacuum switch tube according to the present invention.
Figure 4:
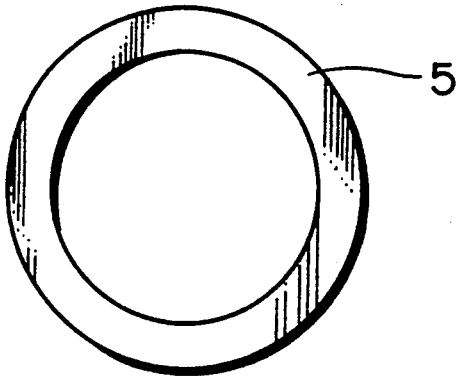
FIG. 4 is a plan view showing one embodiment of an annular electrode of the vacuum switch tube according to the present invention.
Figure 5:
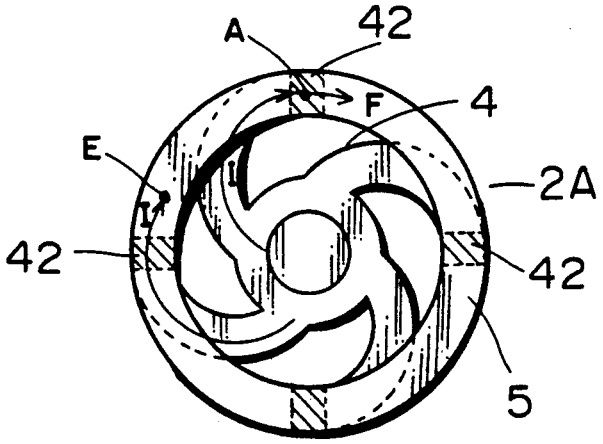
FIG. 5 is an illustration of arc current rotation associated with one of the vacuum switch tube electrodes according to the present invention.
Figure 6:
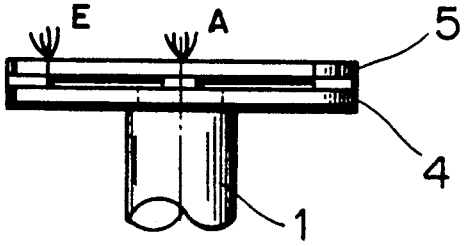
FIG. 6 is a side view of FIG. 5.
Figure 7:
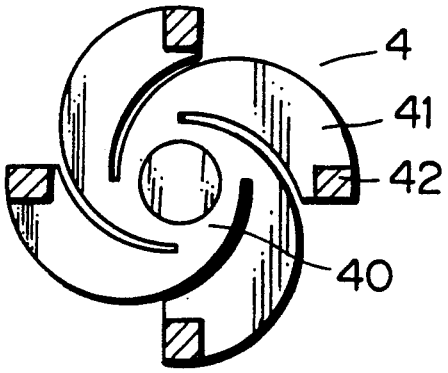
FIG. 7 is a plan view showing another embodiment of a vacuum switch tube electrode according to the present invention.
Figure 8:
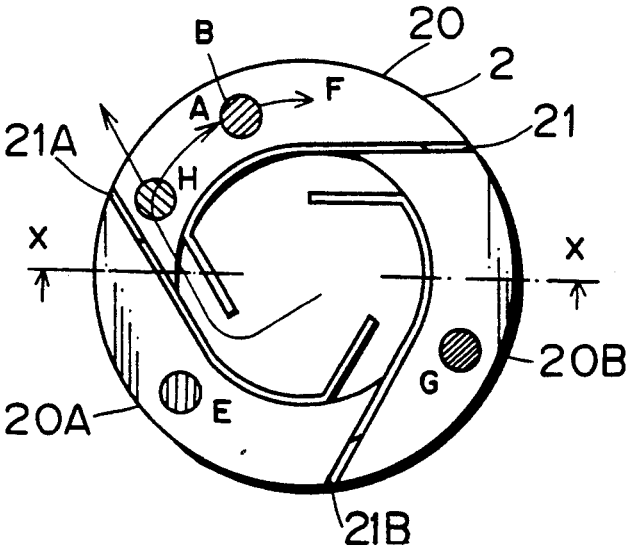
FIG. 8 PRIOR ART
FIG. 8 is a plan view showing a windmill type electrode of a conventional vacuum switch tube.
Figure 9:
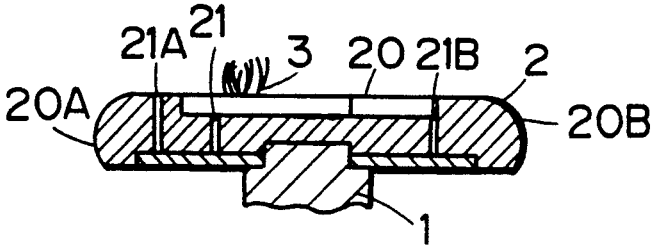
FIG. 9 PRIOR ART
FIG. 9 is a side sectional view of FIG. 8.

The following is a detailed explanation regarding the present invention in accordance with one embodiment thereof referring to FIGS. 1 to 6. In the figures, reference numeral 1 denotes a pair of electrode bars (not shown); one of which is a fixed electrode bar and the other is a perpendicularly movable electrode bar which is located right beneath the fixed electrode bar opposing thereto, wherein a windmill type electrode 2A is detachably disposed at the end portion of each of these electrode bars in such a manner that two windmill type electrodes are facing respectively to each other. In addition, the electrode 2A is integrally formed with the auxiliary electrode 4 and the annular ("ring-shaped") electrode 5, which is a different construction from that of the conventional electrode.

The above auxiliary electrode 4 is composed of a center portion 40 fixed to an end portion of the electrode 1, a plurality of arcuate arm portions 41 which form a windmill or a substantially spiral shape and extend directly in an arcuate manner from the center portion 40 toward the external periphery thereof, and a plurality of connecting portions 42 respectively disposed at end portions of these arm portions 41. In the embodiment shown in the figures, the direction of spiral of the arcuate arm portions 41, from the center portion 40 to the external periphery thereof, is clockwise.

Further, the above annular electrode 5 is formed in a circular shape, the width of which coincides with that of each of the arm portions 41 of the auxiliary electrode 4 and is connected to the plurality of connecting portions 42.

Accordingly, when an arc current is generated at the point A in the connecting portion 42 at which the auxiliary electrode 4 and the annular electrode 5 are connected to each other, since the current path along which an electric current flows in the arm portion 41 of the auxiliary electrode 4 coincides with the activating direction F of the arc current 3, the arc current 3 moves around the external periphery of the annular electrode 5 and rotates.

Further, when the arc current is generated at the point E, since the current path along which an electric current flows in the auxiliary electrode 4 and the annular electrode 5 coincides with the activating direction of the arc current 3, the arc current 3 rotates on the annular electrode 5.

Then, since there is no groove present in the annular electrode 5 as was conventionally done, the arc current 3 is capable of continuing a stable rotation without an occurrence of any variation of its moving velocity.

Although in the above embodiment the width of the arm portions 41 of the auxiliary electrode 4 and that of the annular electrode 5 are the same size, the same effect can be attained by making the width of the arm portions 41 even wider than that of the annular electrode 5.

In summary, according to the present invention, each of the pair of windmill type electrodes comprises an auxiliary electrode 4 whose center portion is fixed to an electrode bar disposed inside the vacuum switch tube and having a plurality of arcuate arms extendingly directed from the center portion toward the external periphery thereof, and an annular electrode which is connected to a plurality of connecting portions provided at the arcuate arms so as to be integrally formed with the auxiliary electrode, so that an arc current activating force in the circumferential direction is raised, and its breaking function can be greatly improved.

Although the invention has been described with a certain degree of particularity, obviously many changes and variations are possible therein. It is therefore to be understood that the invention may be practiced otherwise than specifically described herein without departing from the scope and spirit thereof.

What is claimed is;

1. A vacuum switch tube electrical assembly comprising:

a pair of windmill type electrodes, each including
- an auxiliary electrode including
  - a central hub portion having an axis; and
  - a plurality of arcuate arms, each arcuate arm having proximate and distal ends, each arcuate arm being attached at the proximate end to the central hub portion and extending outward in a spiral direction along a plane that is substantially perpendicular to the axis of the central hub portion, and each arcuate arm having a connecting portion formed on a top side of the arcuate arm near the distal end; and
- a ring-shaped electrode having top and bottom sides, the bottom side connected to the connecting portions of the plurality of arcuate arms; and a pair of electrode bars, each electrode bar having a top end upon which is mounted the central hub portion of one of the pair of windmill type electrodes so that the hub axis is coincident with an axis of the electrode bar;

wherein the electrode bars are disposed in axial alignment within the vacuum switch tube so that the pair of windmill type electrodes are engageable and disengageable with one another.

2. A vacuum switch tube electrode assembly as claimed in claim 1, wherein one of said electrode bars is a fixed electrode bar and the other electrode bar is movable along its axis.

3. A vacuum switch tube electrode assembly as claimed in claim 1, wherein a width of each of said connecting portions of said auxiliary electrode is the same as a width of a connected portion of said ring-shaped electrode.

4. A vacuum switch tube electrode assembly according to claim 1, wherein distal portions of respective inner and outer side edges of each of the arcuate arms are aligned with portions of respective inner and outer circumferential edges of the ring-shaped electrode, whereby a rotating force of an arc current is augmented.

5. A vacuum switch tube electrode assembly according to claim 1, wherein the plurality of arcuate arms of a first one of the windmill type electrodes has a same direction of spiral as the plurality of arcuate arms of a second one of the windmill type electrodes.

* * * * *